United States Patent [19]

Edmark

[11] Patent Number: 5,036,870

[45] Date of Patent: Aug. 6, 1991

[54] HAIR STYLING TOOL

[76] Inventor: Tomima L. Edmark, 6522 Mimosa La., Dallas, Tex. 75230

[21] Appl. No.: 419,106

[22] Filed: Oct. 10, 1989

[51] Int. Cl.[5] ..... A45D 8/34

[52] U.S. Cl. ..... 132/273; 132/212

[58] Field of Search ..... 132/273, 275, 212

[56] References Cited

U.S. PATENT DOCUMENTS

| | | | |
|---|---|---|---|
| 1,146,934 | 7/1915 | Gleeson | 132/273 |
| 1,548,246 | 8/1925 | Bennett | 132/273 |
| 1,892,262 | 12/1932 | Andrew | 132/273 |
| 2,357,871 | 9/1944 | Bolinger | 132/275 |

*Primary Examiner*—John J. Wilson
*Assistant Examiner*—Frank A. LaViola
*Attorney, Agent, or Firm*—Richards, Medlock & Andrews

[57] ABSTRACT

A tool (10) is provided for inverting a hair tail (20) of hair to provide a pleasing hair style. The tool includes a cylindrical probe (12) with a point (14) which is inserted through the hair tail at a distance from the end of the hair tail. A loop (16) is attached to the end of the probe, and the end of the hair tail is passed through. The probe and loop are then pulled through the hair tail to invert the hair tail.

4 Claims, 1 Drawing Sheet

HAIR STYLING TOOL

TECHNICAL FIELD

This invention relates to personal grooming, and in particular to creation of an attractive hair appearance.

BACKGROUND OF THE INVENTION

Hair styling is an important part of personal grooming and appearance. Much time and money is spent on preparing the appearance of a person's hair, and an entire industry has developed full of products and services to fulfill this demand.

As the pace of life continues to accelerate, there is an ever increasing desire to minimize the time required to prepare an attractive hair style. Therefore, a need exists for apparatus and methods which assist in the creation of an attractive hair style in a minimum amount of time.

SUMMARY OF THE INVENTION

In accordance with one aspect of the present invention, a tool is provided for inverting a hair tail. The tool has an elongate probe with a first end and a second end. The probe is inserted in the hair tail at a distance from the end of the hair tail. A loop is attached to the probe at the second end thereof. The end of the hair tail is inserted through the loop and the probe and loop are pulled through the hair tail to invert the hair tail.

In accordance with other aspects of the present invention, the probe is preferably an elongate cylindrical member coming to a point at the first end. The loop is preferably formed of a resilient material which allows it to deform as it passes through the hair tail and rebound to its original shape.

In accordance with another aspect of the present invention, a method for inverting a hair tail is provided. The method includes the step of inserting a first end of an elongate probe into the hair tail at a distance from the end of the hair tail. The method continues with the step of passing the end of the hair tail through a loop attached to the opposite, second end of the elongate probe and pulling the elongate probe and loop through the hair tail to invert the hair tail.

BRIEF DESCRIPTION OF THE DRAWINGS

A more complete understanding of the invention can be had by referring to the following Detailed Description, taken with the accompanying drawings, wherein.

DETAILED DESCRIPTION

Figure 1:
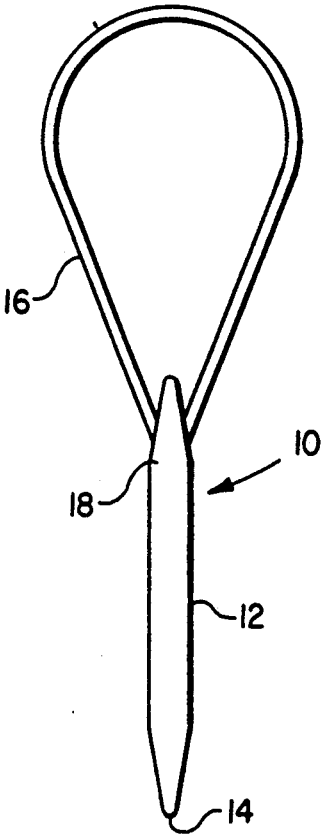
FIG. 1 is a side view of a tool forming a first embodiment of the present invention.

Referring now to the drawings, wherein like reference numerals designate like or corresponding parts throughout the several views, and in particular to FIG. 1, there is illustrated a tool 10 forming a first embodiment of the present invention. The tool 10 includes a relatively elongate and inflexible cylindrical probe 12 which extends to a point 14 at a first end thereof. An elastic loop 16 is secured to the probe at the second end 18 of the probe. The loop 16 is preferably made of a material such as plastic, which can resiliently deform under the influence of external forces, but rebound to its ringlike shape when those forces have been removed. In deformation, the circumference of the loop will not vary significantly, if at all. The deformation occurs in the flexing of the material forming the loop, which allows the opening through the loop to conform to the hair.

Figure 2A:
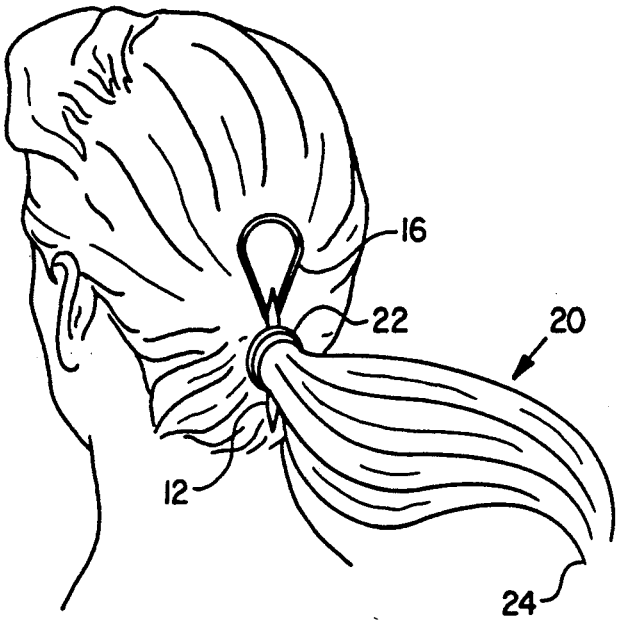
FIGS. 2A–C illustrate the use of the tool to invert a hair tail.
Figure 2B:
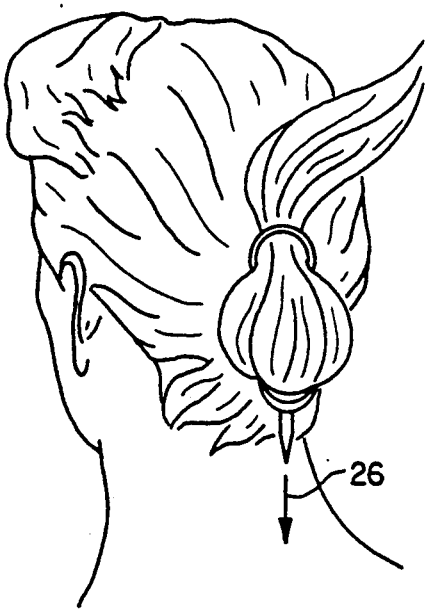
Figure 2C:
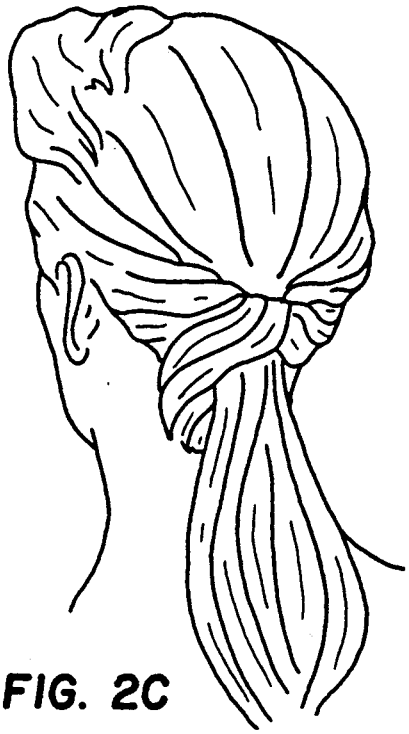

With reference now to FIGS. 2A–C, the representation of a hair tail 20 is illustrated, which is a common form of hair style considered easy to prepare, yet attractive. Such hair tails can be ponytails, pigtails, puppy tails and puppy ears and the like. Quite often, an element 22, such as a rubber band or elastic tie, is used to bind the hair tail. As will be described hereinafter, the tool 10 can be used to invert the hair tail to provide a pleasing and unique hair style as illustrated in FIG. 2C.

To invert the hair tail, the point 14 of the probe 12 is inserted through the hair tail between the element 22 and the head, as shown in FIG. 2A. The point 14 allows the probe to be inserted to glide with little friction through the hair, and without pulling excessively on the hair itself.

The end 24 of the hair tail is then passed through the loop 16 from one side thereof as illustrated in FIG. 2B. The flexibility of the loop allows it to expand or deform as necessary as the hair is pulled therethrough.

Finally, the probe and loop are pulled through the hair tail in the direction of arrow 26 in FIG. 2B to pull the end 24 of the hair tail through part of the hair tail to invert the hair tail. As the hair tail is inverted, the loop 16 naturally slides off of the end of the hair tail, and the tool 10 comes free of the hair. Again, the flexibility of the loop 16 allows it to flatten or deform as it is pulled through the hair, yet rebound to its natural ring shape.

Depending on preference, the tool 10 can be made as an integral unit of one material, such as plastic, or in two parts welded, glued, or otherwise secured together, which permits the probe and loop to be made of different materials. For example, the probe 12 could be made of metal or semi-rigid plastic, while the loop 16 is made of resilient plastic.

While only a single embodiment of the invention has been illustrated in the accompanying drawings, and described in the foregoing Detailed Description, it will be understood that the invention is not limited to the embodiment disclosed, but is capable of numerous rearrangements, modifications and substitutions of parts and elements without departing from the spirit of the invention.

I claim:

1. A tool for inverting a hair tail of hair by the application of external force, the hair tail having an end, said tool comprising:

an elongate probe having a first end and a second end, the probe for insertion in a hair tail at a distance from the end of a hair tail to glide with little friction through the hair;

a loop defining an opening and having an undeformed, original shape, said loop attached to the probe at the second end thereof, the end of a hair tail inserted through the loop and the probe and loop pulled through a hair tail to invert a hair tail, the loop formed of a resilient material which allows it to deform as it passes through a hair tail under the influence of the external forces and rebound to its original shape when those forces have been removed, the opening through the loop conforming to a hair tail.

2. The tool of claim 1 wherein the probe is a semi-rigid cylindrical probe with the first end being a point.

3. A method for inverting a hair tail of hair, the hair tail having an end, said method comprising the steps of:

inserting a first end of an elongate probe through a hair tail at a distance from the end of a hair tail, said elongate probe having an opposite, second end;

inserting the end of a hair tail through a loop attached to the probe at the opposite, second end thereof; and pulling the probe and loop through a hair tail so that the end of a hair tail is passed through a hair tail to invert a hair tail.

4. The method of claim 3 further comprising the step of pulling the probe and loop after the hair tail has been inverted to slide the loop off of the end of the hair tail to release the probe and loop from the hair.

* * * * *

US005036870A

REEXAMINATION CERTIFICATE (2629th)

United States Patent [19]

Edmark

[11] B1 5,036,870

[45] Certificate Issued Jul. 18, 1995

[54] HAIR STYLING TOOL

[76] Inventor: Tomima L. Edmark, 6522 Mimosa La., Dallas, Tex. 75230

Reexamination Request:
No. 90/003,138, Jul. 23, 1993

Reexamination Certificate for:

| | |
|---|---|
| Patent No.: | **5,036,870** |
| Issued: | **Aug. 6, 1991** |
| Appl. No.: | **419,106** |
| Filed: | **Oct. 10, 1989** |

[51] Int. Cl.[6] ..... A45D 8/34

[52] U.S. Cl. ..... 132/273; 132/212; 132/210

[58] Field of Search ..... 132/212, 273, 275; 223/99; 446/15, 16, 296; 66/117, 118, 200, 210

[56] References Cited

U.S. PATENT DOCUMENTS

| | | | |
|---|---|---|---|
| D. 118,810 | 2/1940 | Berry . | |
| 160,705 | 3/1875 | Patterson . | |
| D. 180,164 | 4/1957 | Tupper et al. | D86/8 |
| D. 186,564 | 11/1959 | Patterson | D86/10 |
| D. 190,544 | 6/1961 | Goodman | D86/10 |
| 205,207 | 6/1878 | Parker . | |
| 215,612 | 5/1879 | Howland . | |
| D. 240,669 | 7/1976 | Pifer | D28/99 |
| 258,128 | 5/1882 | Ryder . | |
| 322,284 | 7/1885 | Havell . | |
| 389,664 | 9/1888 | Myers . | |
| 389,863 | 9/1888 | Uhry . | |
| 438,751 | 10/1890 | Hodge . | |
| 879,126 | 2/1908 | Angus . | |
| 1,091,395 | 3/1914 | Senceubaugh | 66/118 |
| 1,170,278 | 2/1916 | Knechtel | 223/99 |
| 1,192,623 | 7/1916 | Hallett | 66/118 |
| 1,241,337 | 9/1917 | Breitenstein . | |
| 1,343,213 | 6/1920 | Johnson et al. . | |
| 1,400,637 | 12/1921 | Szlanyi . | |
| 1,415,472 | 5/1922 | Puc | 66/118 |
| 1,476,895 | 12/1923 | Langenbacher . | |
| 1,769,953 | 7/1930 | Holland . | |
| 1,890,512 | 12/1932 | Kelle . | |
| 1,892,262 | 12/1932 | Andrew | 132/273 |
| 2,074,817 | 3/1937 | Von Bargen . | |
| 2,150,260 | 3/1939 | Berry . | |
| 2,245,515 | 6/1941 | Williams . | |
| 2,582,339 | 1/1952 | Krueger . | |
| 2,597,254 | 5/1952 | Meohas . | |
| 2,646,298 | 7/1953 | Leary . | |
| 2,655,924 | 10/1953 | Petitta . | |
| 2,668,644 | 2/1954 | Lillard et al. . | |
| 2,832,358 | 4/1958 | Chambers . | |
| 2,845,670 | 8/1958 | Brown et al. . | |
| 2,847,016 | 8/1958 | Rabinowitz . | |
| 2,943,371 | 7/1960 | Patterson . | |
| 3,006,518 | 10/1961 | Lillard . | |
| 3,081,781 | 3/1963 | Stermer . | |
| 3,099,271 | 7/1963 | Dubelier . | |
| 3,295,535 | 1/1967 | Amato . | |
| 3,402,959 | 9/1968 | Harris . | |
| 3,409,029 | 11/1968 | Kumpa . | |
| 3,640,289 | 2/1972 | Sbarra . | |
| 3,662,766 | 5/1972 | Maassen et al. | 132/5 |
| 3,678,945 | 7/1972 | Reynoir et al. | 132/46 R |
| 3,838,801 | 10/1974 | David | 223/99 |
| 3,889,692 | 6/1975 | Redrow | 132/7 |
| 4,133,339 | 1/1979 | Naslund . | |
| 4,307,908 | 12/1981 | Donaldson . | |
| 4,315,362 | 2/1982 | Pigford et al. . | |
| 4,369,690 | 1/1983 | Sapkus | 87/33 |
| 4,607,505 | 8/1986 | Dunker et al. | 66/117 |
| 4,667,860 | 5/1987 | Feuerman . | |
| 4,830,029 | 5/1989 | Bird | 132/54 |
| 4,942,646 | 7/1990 | Sebastian | 24/40 |
| 4,961,439 | 10/1990 | Hartmann | 132/212 |
| 4,972,660 | 11/1990 | Black | 54/78 |
| 4,974,488 | 12/1990 | Spralja | 87/8 |
| 4,998,544 | 3/1991 | Obergfell | 132/212 |
| 5,036,870 | 8/1991 | Edmark . | |
| 5,086,612 | 2/1992 | Anderson | 54/78 |
| 5,135,422 | 8/1992 | Bowen | 446/15 |
| 5,167,245 | 12/1992 | Harriett | 132/273 |
| 5,168,789 | 12/1992 | Suzuki | 87/6 |

FOREIGN PATENT DOCUMENTS

| | | | |
|---|---|---|---|
| 505272 | 8/1951 | Belgium | 446/16 |
| 1393317 | 12/1963 | France . | |
| 308793 | 10/1917 | Germany | 66/118 |
| 3416 | of 1899 | United Kingdom . | |
| 20090 | of 1912 | United Kingdom | 66/118 |
| 2153222 | 8/1985 | United Kingdom . | |

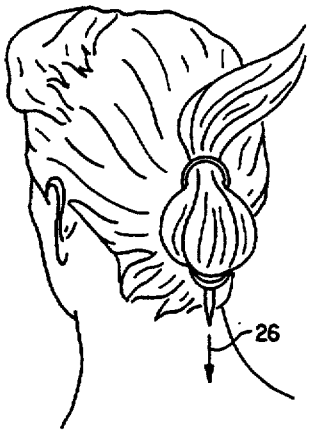

OTHER PUBLICATIONS

American Hairdresser Magazine (Aug. 1905), at 56.

J. Stevens, Cox, *An Illustrated Dictionary of Hairdressing and Wigmaking* (1984).

Georgine de Courtais, *Women's Headdress and Hairstyles* (1973).

Susan E. Harris, *Grooming to Win* Second Edition (1991) pp. 32–51.

Frank Madden and Bill Cooney *Fit to Show The Guide to Grooming Your Horse* (1985) pp. 52–61.

Charlene Strickland, *Show Grooming The Look of a Winner*, 1986 pp. 62–69.

Creer, Edwin, *Board-Work; Or the Art of Wig-Making*, R. Hogenden & Sons, London, England (1887), pp. 73–96.

Harris, Susan, *Grooming To Win*, Robert Hole, Ltd., (1977), pp. 100–127.

*Primary Examiner*—John G. Weiss

[57] ABSTRACT

A tool (10) is provided for inverting a hair tail (20) of hair to provide a pleasing hair style. The tool includes a cylindrical probe (12) with a point (14) which is inserted through the hair tail at a distance from the end of the hair tail. A loop (16) is attached to the end of the probe, and the end of the hair tail is passed through. The probe and loop are then pulled through the hair tail to invert the hair tail.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3 and 4 is confirmed.

Claims 1 and 2 are cancelled.

New claims 5 and 6 are added and determined to be patentable.

*5. A method for inverting a hair tail of hair, the hair tail having an end, said method comprising the steps of:*

*inserting a first end of an elongate probe through a hair tail at a distance from the end of a hair tail, said elongate probe having an opposite, second end;*

*inserting the end of a hair tail through a resilient loop attached to the probe at the opposite, second end thereof; and*

*pulling the probe and loop through the hair tail so that the end of a hair tail is passed through a hair tail to invert a hair tail.*

*6. The method of claim 5 further comprising the step of pulling the probe and loop after the hair tail has been inverted to slide the loop off of the end of the hair tail to release the probe and loop from the hair.*

* * * * *